US005167265A

United States Patent [19]

Sakamoto

[11] Patent Number: 5,167,265

[45] Date of Patent: Dec. 1, 1992

[54] HAND-OPERATED BINDING DEVICE

[75] Inventor: Kazumo Sakamoto, Kawaguchi, Japan

[73] Assignee: Kyoichi Limited, Tokyo, Japan

[21] Appl. No.: 725,306

[22] Filed: Jul. 5, 1991

[51] Int. Cl.[5] ..... B21F 9/02

[52] U.S. Cl. ..... 140/93.2; 140/93 A

[58] Field of Search ..... 140/53, 57, 93 A, 123.6, 140/93.2

[56] References Cited

U.S. PATENT DOCUMENTS 3,946,769 3/1976 Caveney et al. ..... 140/93.2

4,178,973 12/1979 Collier et al. ..... 140/93 A

*Primary Examiner*—Lowell A. Larson

*Attorney, Agent, or Firm*—Griffin, Butler, Whisenhunt & Kurtossy

[57] ABSTRACT

A hand-operated binding device which may be used to bind objects, for example, a bundle of electric wires, with a binding band. The binding device is provided with a means for transporting a binding band by a manual operation, the binding band comprising a band portion with engagement portions and a head portion with a hole and a locking projection. The binding device is further provided with a pair of first and second guide members capable of opening and closing as well as reducing a space for accommodating an object to be bound. In addition, the binding device is provided with a means for driving at least one of the first and second guide members by a manual operation. The binding band that is transported by the transport means is bent around the object in the space through the first and second guide members, and the band portion with the engagement portions is passed through the hole in the head portion by utilization of the elastic deformation of the locking projection.

19 Claims, 11 Drawing Sheets

FIG.18
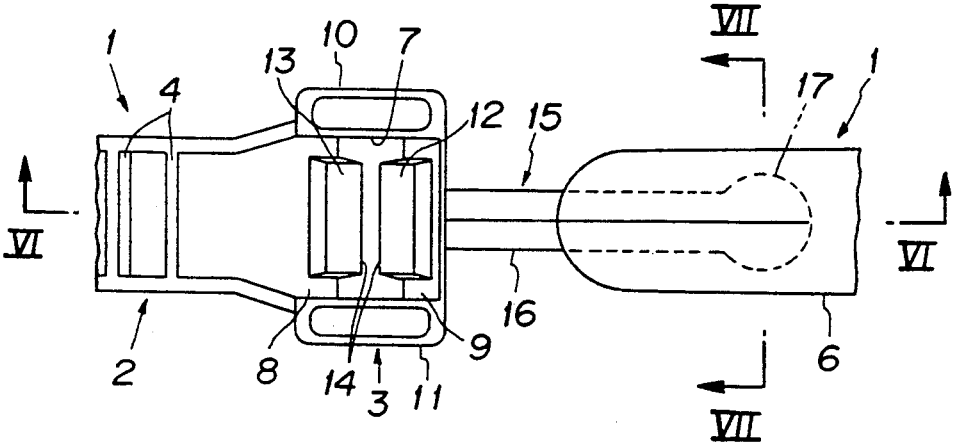
FIG.19
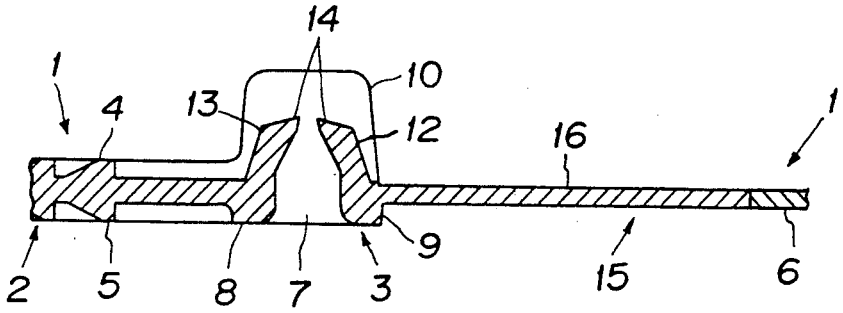
FIG.21
FIG.20
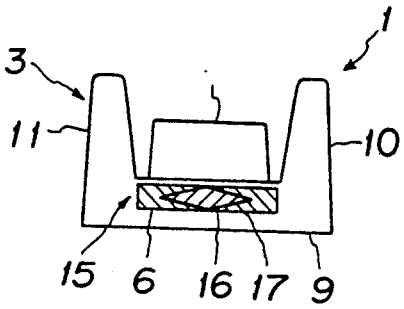
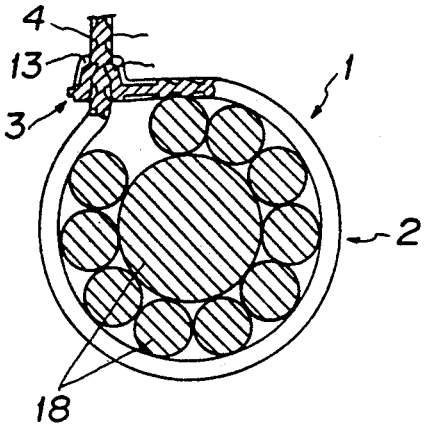

HAND-OPERATED BINDING DEVICE

BACKGROUND OF THE INVENTION

The present invention relates to a hand-operated binding device which may be used to bind various kinds of objects with a binding band, for example, to bind a bundle of electric wires with a binding band, or to tie a young plant to a support piece of wood.

To effect wiring in an electric installation work, for example, a bundle of electric wires is bound with a binding band. Such a binding work has heretofore been effected by use of an automatic binding device such as that disclosed, for example, in U.S. Pat. No. 3,946,769. The conventional automatic binding device will be briefly explained below.

A binding band is discharged from a cartridge and fed to a tool through a chute. At the tool, the band portion of the binding band fed thereto is bent in the form of a loop around a bundle of of electric wires by the cooperation of a pair of first and second guide members, and the head portion of the binding band is stopped and retained in position with a stopper. In this state, the first guide member is driven by a driving means to reduce the space that is defined by the first and second guide members for accommodating objects to be bound, thereby reducing the loop of the binding band so that the distal end portion of the band portion is inserted and passed through a hole in the head portion by utilization of the elastic deformation of a locking member provided on the head portion. The end portion of the band portion that projects from the head portion is pulled by a stretching means, so that the following band portion is passed through the hole in the head portion by utilization of the elastic deformation of the locking member, thereby reducing the loop to fasten the bundle of electric wires tight. Thereafter, the end portion of the band portion that projects from the head portion is cut off by a cutting means, and the cut piece of the band portion is discharged to the outside by the action of the stretching means. Then, the first guide member is returned to the original position by the driving means.

However, the above-described conventional automatic binding device employs compressed air to feed a binding band from the cartridge to the tool by use of the chute and also employs an air cylinder device and a motor as drive sources for the driving means, the stretching means, the cutting means, etc. For this reason, the prior art needs attached equipment such as a compressed air supply source, a power source, etc., so that the place where the binding device is usable is limited. Thus, the prior art is inferior in general-purpose properties.

SUMMARY OF THE INVENTION

It is an object of the present invention to provide a hand-operated binding device which is designed so that objects of binding, for example, a bundle of electric wires, can be bound by a manual operation, thereby eliminating the limitation on the place where it is usable, and thus obtaining general-purpose properties.

To attain the above-described object, the present invention provides a hand-operated binding device which comprises: means for transporting a binding band by a manual operation, the binding band comprising a band portion with engagement portions and a head portion with a hole and a locking projection; a pair of first and second guide members capable of opening and closing as well as reducing a space for accommodating an object to be bound, the guide members being arranged to guide the band portion of the binding band transported by the transport means such that the band portion is bent around the object, and to pass the band portion through the hole in the head portion by utilization of the elastic deformation of the locking projection; and means for driving by a manual operation at least one of the first and second guide members such that the space can be opened and closed as well as reduced.

Thus, it is possible according to the present invention to bend the binding band around the object, pass the band portion through the hole in the head portion and engage the engagement portions of the band portion with the locking projection of the head portion by manually operating the binding band transport means and further manually operating the drive means for opening and closing the first and second guide members. Since there is no need for attached equipment such as a compressed air supply source and a power source as in the prior art, it is possible to eliminate the limitation on the place where the binding device is usable and hence possible to obtain general-purpose properties.

BRIEF DESCRIPTION OF THE DRAWINGS

FIGS. 1 to 14 show a first embodiment of the hand-operated binding device according to the present invention, in which:

FIG. 1 is a front view of the first embodiment;

FIG. 2 is a rear view of the first embodiment;

FIG. 3 is a plan view of the first embodiment;

FIG. 4 is a partly-cutaway front view of the first embodiment with a front cover removed therefrom;

FIG. 5 is a rear view of the first embodiment with a rear cover removed therefrom;

FIG. 6 is a sectional view in the direction of the arrow I—I in FIG. 5;

FIG. 7 is a sectional view in the direction of the arrow II—II in FIG. 5;

FIG. 8 is a sectional view similar to FIG. 7, which is taken along a line that is a little lower than in FIG. 7;

FIG. 9 is a sectional view in the direction of the arrow III—III in FIG. 4;

FIG. 10 is a sectional view in the direction of the arrow IV—IV in FIG. 4;

FIG. 11 is a sectional view in the direction of the arrow V—V in FIG. 4;

FIG. 12 is a fragmentary plan view showing a means for pressing a binding band and a means for pressing a first guide member;

FIG. 13 is a front view of the arrangement shown in FIG. 12; and

FIG. 14 is an enlarged sectional view of a means for stopping the backward movement of a binding band.

FIGS. 17 to 21 show a binding band which may be employed in the present invention, in which:

FIG. 17 is a fragmentary plan view of a series of binding bands;

FIG. 18 is an enlarged view of an essential part of the binding band;

FIG. 19 is a sectional view in the direction of the arrow VI—VI in FIG. 18;

FIG. 20 is a sectional view in the direction of the arrow VII—VII in FIG. 18; and FIG. 21 illustrates electric wires which are bound with a binding band cut off from a series of binding bands.

DETAILED DESCRIPTION OF THE INVENTION

Figure 1:
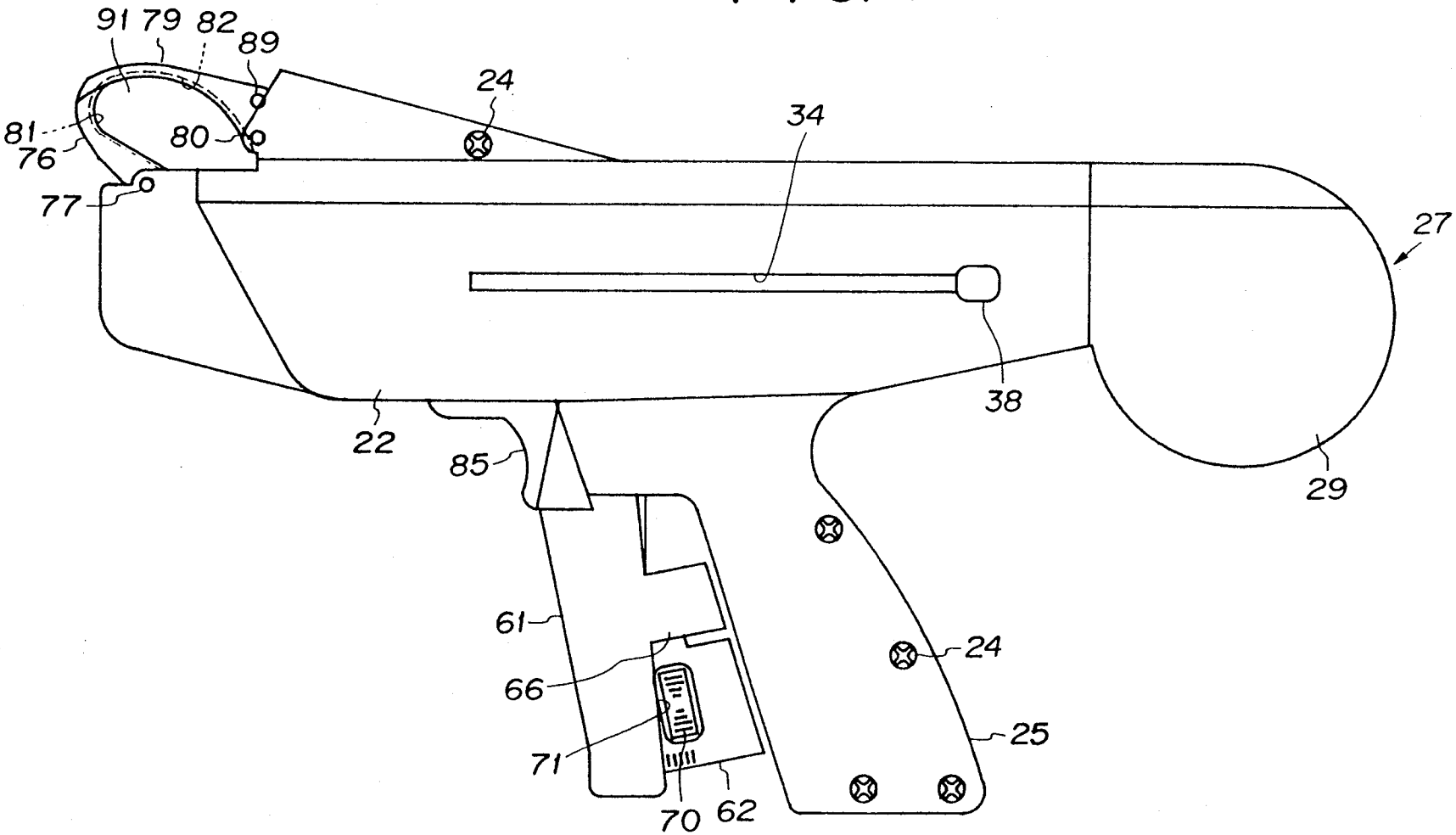
Figure 2:
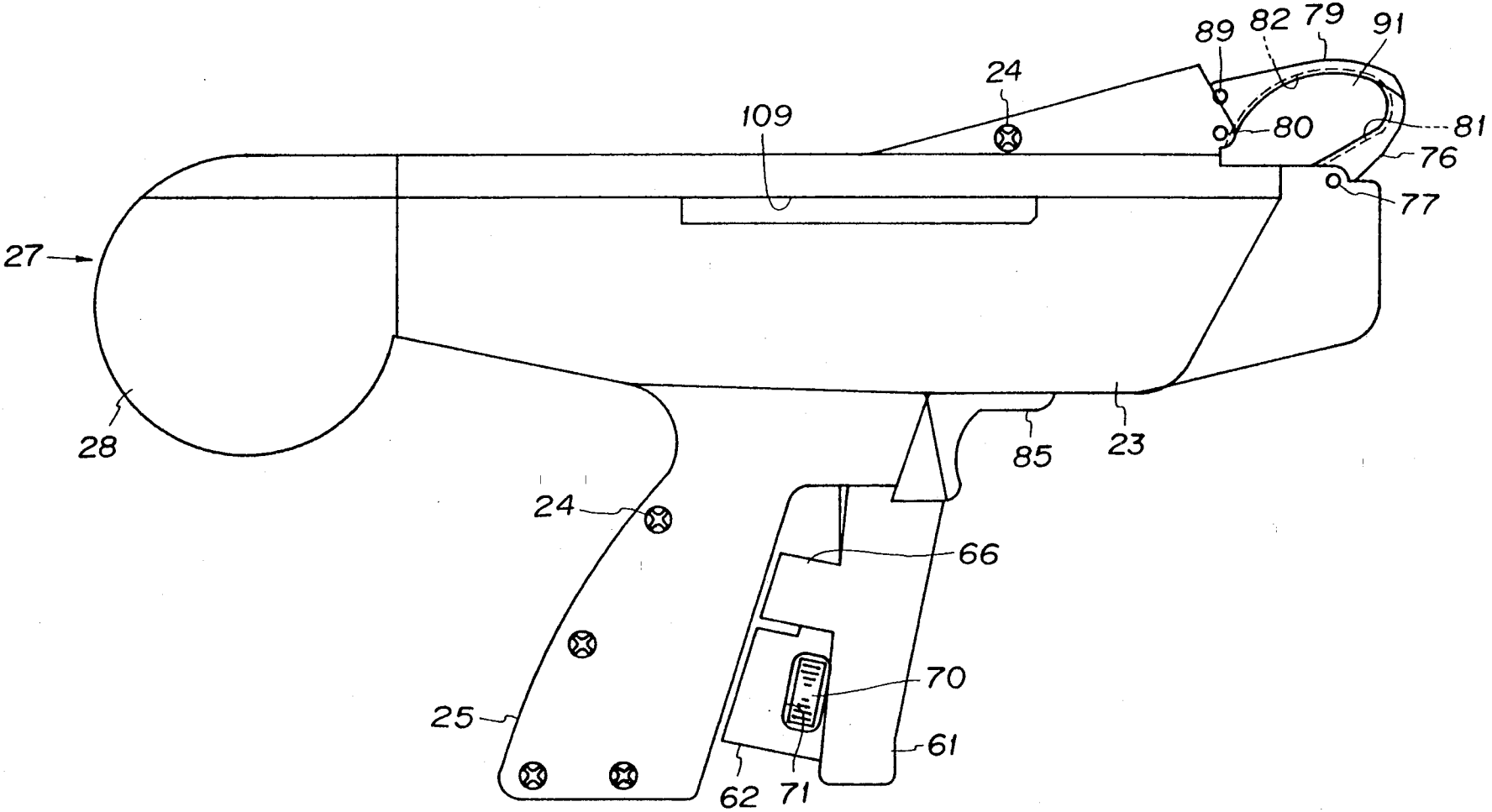
Figure 3:
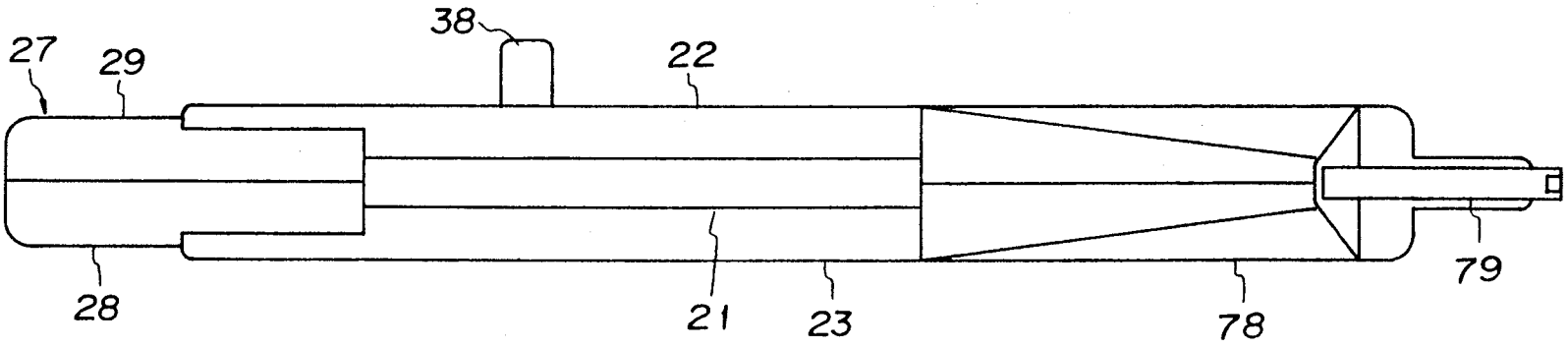

Embodiments of the present invention will be described below with reference to the accompanying drawings.

First, one example of binding bands which may be used in the present invention will be explained.

Referring to FIGS. 17 to 20, a binding band 1, which is made of a polymeric material, comprises a band portion 2 and a head portion 3 which is provided contiguously with the proximal end of the band portion 2. The band portion 2 is formed in the shape of a long and narrow band. Both the flat sides of the band portion 2 are provided with first and second rows of engagement portions 4 and 5, respectively, each row comprising a large number of engagement portions arranged side by side longitudinally. The band portion 2 has a thin-walled distal end portion 6, which gradually decreases in width toward the distal end. The head portion 3, which is formed in a square frame-like shape, has a hole 7 for insertion of the band portion 2. The head portion 3 has a wall 8 at the end thereof which is contiguous with the band portion 2 and another wall 9 at the end thereof which is remote from the band portion 2. The opposing walls 8 and 9 are lower than another pair of opposing walls 10 and 11 of the head portion 3. A pair of first and second locking projections 12 and 13 are provided at the respective outer ends of the opposing walls 8 and 9 at the exist side of the hole 7, the locking projections 12 and 13 extending in the direction of insertion of the band portion 2. The locking projections 12 and 13 are separate from the opposing walls 10 and 11, which face each other across them, so as to have flexibility. The locking projections 12 and 13 each have an inner configuration which corresponds to the outer configuration of the first and second engagement portions 4 and 5. In addition, engagement portions 14 are formed at the distal ends of the locking projections 12 and 13 so as to reduce the hole 7. The opposing walls 10 and 11 are set to project higher than the first and second locking projections 12 and 13. The gap between the distal ends of the engagement portions 14 of the first and second locking projections 12 and 13 is set to be smaller than the thickness of the thin walled portion defined between each pair of engagement portions 4 (5) of the band portion 2. The respective portions of the opposing walls 8 and 9 which are at the entrance side of the hole 7 are chamfered to facilitate the insertion of the band portion 2.

A large number of binding bands 1 arranged as described above are connected in series longitudinally in such a manner that the head portion 3 of a first binding band 1 is connected to the distal end portion 6 of the band portion 2 of a second binding band 1 by a connecting portion 15. More specifically, a plate-shaped connecting piece 16 projects from the rear of the wall 9 of the head portion 3 away from the band portion 2, the connecting piece 16 being formed as an integral part of the wall 9 and having a smaller width than that of the distal end portion 6. The connecting piece 16 has a disk-shaped portion provided at the distal end thereof to define sideward projecting portions 17. The obverse and reverse sides of the connecting piece 16 gradually decrease in thickness from the center line to both the longitudinally extending edges so as to define a lozenge-shaped cross-section. Thus, a first binding band 1 with such a connecting piece 16 is first formed by molding process, and when the following, second binding band 1 with a connecting piece 16 is molded, the distal end portion of the connecting piece 16 of the first binding band 1 is insert-molded with respect to the distal end portion 6 of the second binding band 1. At this time, the distal end portion 6 of the second binding band 1 reaches the inner side of the sideward projecting portions 17 of the connecting piece 16 of the first binding band 1, that is, the side of the projecting portions 17 which is closer to the head portion 3, thereby enabling the distal end portion 6 of the second binding band 1 and the connecting piece 16 of the first binding band 1 to be connected together in an integral structure so that the connecting piece 16 is reliably prevented from coming off the distal end portion 6 even if the first and second binding bands 1 are pulled away from each other. In addition, the distal end portion 6 of the second binding band 1 sandwiches the connecting piece 16 of the first binding band 1 from two directions corresponding to the two flat sides of the band portion 2, so that the distal end portion 6 and the connecting piece 16 are integrally connected together in a state where these will not separate from each other even when bent longitudinally. In this way, a large number of binding bands 1 are connected in series longitudinally.

A continuous binding band that comprises a large number of binding bands 1 connected in series longitudinally can be wound up in the longitudinal direction in which the binding bands 1 are connected in series. At this time, the binding bands 1 can be reliably maintained in the continuous form since the mutal connecting portion 15 of each pair of adjacent binding bands 1 is integrally formed in a state where the distal end portion 6 and the connecting piece 16 are prevented from coming off even when pulled away from each other and also prevented from separating even when bent, as described above. In addition, each binding band 1 can be supplied successively in the feed direction inside a hand-operated binding device, described later, from the rear side thereof. Since no portion of a binding band 1 projects sidewardly, even if the number of binding bands 1 wound up is large, there is no interference with the operation. Accordingly, it is possible to increase the number of binding bands 1 wound up and hence improve the efficiency of the binding operation. In addition, since the binding bands 1 are wound up longitudinally without a free end, the binding bands 1 can be smoothly unwound without any fear of binding bands 1 becoming entangled with each other and can therefore be reliably fed. The hand-operated binding device performs a binding work with binding bands 1 fed and successively cuts them off at each connecting portion 15. Since the binding bands 1 are connected in series longitudinally, as described above, each connecting portion 15 can be shortened and the loss of material can be minimized.

To bind electric wires with a cut binding band 1, a bundle of electric wires 18 is bound with the band portion 2 and the distal end portion 6 of the band portion 2 is passed through the hole 7 in the head portion 3 and pulled, as shown in FIG. 21. By so doing, the first and second engagement portions 4 and 5 can be passed through the locking projections 12 and 13 by utilization of the elastic deformation thereof. After the bundle of electric wires 18 has been fastened tight in this way, the band portion 2 is released from the pulling force. In consequence, the first and second engagement portions 4 and 5 are engaged with the first and second locking projections 12 and 13 to lock the binding band 1 with the electric wires 18 being fastened tight therewith, thus binding the bundle of electric wires 18. Since the gap between the distal ends of the engagement portions 14 of the first and second locking projections 12 and 13 is set to be smaller than the thickness of the thin-walled portion between each pair of engagement portions 4 (5) of the band portion 2, the engagement portions 14 are pressed to cut into the thin-walled portion by the repelling resilience of the first and second locking projections 12 and 13, so that these locking projections 12 and 13 can reliably engage the first and second engagement portions 4 and 5 to prevent backward motion, thereby locking the binding band 1. After the binding, the distal end portion of the band portion 2 that projects from the first and second locking projections 12 and 13 may be cut off at an appropriate position. Since the opposing walls 10 and 11, which face each other across the first and second locking projections 12 and 13, are set to project higher than these locking projections 12 and 13, as described above, the locking projections 12 and 13 can move freely when objects are bound by the hand-operated binding device on the basis of the walls 10 and 11 and it is also possible to prevent damage to the first and second locking projections 12 and 13 when the projecting end portion of the band portion 2 is cut off by the hand-operated binding device.

By virtue of the arrangement of the above-described binding band 1, the first and second locking projections 12 and 13 are provided integrally at the respective outer ends of the opposing walls 8 and 9 at the exist side of the hole 7 such that the locking projections 12 and 13 extend in the direction of insertion of the band portion 2 (i.e., upwardly as viewed in FIG. 19), and it is therefore possible to increase the thickness of the locking projections 12 and 13 and hence enhance the strength thereof. Accordingly, it is possible to prevent breakage of the first and second locking projections 12 and 13 even when the first and second engagement portions 4 and 5 pass through the gap between the locking projections 12 and 13, or even if force acts on the bound electric wires 18 in such a manner that these wires 18 are separated from each other. Thus, it is possible to enhance the binding reliability. In addition, since the firs and second locking projections 12 and 13 are integrally provided at the respective outer ends of the opposing walls 8 and 9 of the head portion 3, as described above, the outer shape of the head portion 3 can be made smaller than in the case where locking projections are provided inside the head portion. Accordingly, the head portion 3 can be readily accommodated in a narrow space, and the structure can be simplified. It is therefore possible to simplify the mold construction even if injection molding process is employed and hence possible to provide the binding band 1 at low cost. In addition, the above-described structure of the binding band 1 enables a low-cost material, e.g., polyethylene, polypropylene, etc., to be used even if moldability is inferior. It is also possible to employ a high-strength material, e.g., a glass-fiber reinforced resin material, to thereby reduce the overall size of the product.

When used in the field of agriculture, for example, the binding band 1 may be formed from a biodegradable plastic material or a photodegradable plastic material.

A first embodiment of the hand-operated binding device according to the present invention will next be explained.

Referring to FIGS. 1 to 11, a frame 21 has covers 22 and 23 attached to both sides of the upper part thereof by use of a screw 24. A grip 25 is formed in the center of the bottom of the housing comprising the frame 21 and the covers 22 and 23. The upper part of the frame 21 is formed with a longitudinal passage 26 for transporting a binding band 1.

As shown in FIGS. 1 to 8, a cartridge 27 is interchangeably attached to the rear end of the housing comprising the covers 22 and 23 in such a manner as to communicate with the transport passage 26. The cartridge 27 comprises a body 28 and a cover member 29. The body 28 has a cylindrical core 30 which is provided as an integral part thereof on the inner side of the central portion thereof. The cover member 29 has a ring-shaped projection 31 which is provided as an integral part thereof on the inner side of the center thereof. The cover member 29 has its projection 31 press-fit into the core 30 of the body 28 and is retained by the body 28 in one unit through an engagement portion 32. Thus, the cover member 29 can be removed from the body 28 by disengaging the engagement portion 32. With the cover member 29 removed from the body 28, a binding band roll comprising a large number of binding bands 1 described above is fitted on the bore 30 of the body 28, and the cover member 29 is then attached to the body 28, as stated above. This cartridge 27 is attached to the rear end of the housing that comprises the covers 22 and 23, thus enabling the binding bands 1 in the cartridge 27 to be successively delivered and fed to the transport passage 26.

The binding bands 1 in the cartridge 27 are transported forwardly along the transport passage 26 by a manual transport means. The manual transport means has a press means, which is moved by a means that also serves to move a means for pressing a first guide member 76 (described later). As shown in FIGS. 1, 4, 6, 9, 10, 12 and 13, a pair of opposing guide grooves 33 and 34 are formed in the frame 21 and the cover 22, respectively, below and in parallel to the transport passage 26. The guide groove 33 is engaged with a projection 36 that is formed on the inner end face of a slider 35, and the guide groove 34 is engaged with an intermediate portion of the slider 35 which is defined between grooves 37 that are formed on both the upper and lower surfaces. The end portion of the slider 35 that projects outwardly from the cover 22 is defined as an operating portion 38. Accordingly, the slider 35 is slidable along the transport passage 26 while being guided by the guide grooves 33 and 34. The respective proximal ends of a press shaft 39 and a connecting plate 40 are secured to a portion of the slider 35 which is located inside the cover 22. A press head 41 is secured to the respective distal ends of the press shaft 39 and the connecting plate 40. A movable block 42 is slidably fitted on the intermediate portion of the press shaft 39. The respective sides of the press head 41 and the movable block 42 are formed with projections 43 and 44, which are engaged with the guide groove 33 and guided thereby when the press head 41 and the movable block 42 move. The proximal end of an arm 45 is secured to the side of the movable block 42. The arm 45 projects upwardly inside the cover 22. A press plate 47 is pivotably supported through a shaft 48 on the horizontal upper surface 46 of the arm 45. The press plate 47 is biased by a coil spring 49 so as to pivot clockwise as viewed in FIG. 12 until a stopper 50 engages the end edge of the upper surface. When the press plate 47 is in a state where the pivotal motion thereof is stopped by the stopper 50, a press portion 51 of the plate 47 is inserted into the transport passage 26 through a groove 52 that is formed in the frame 21 (see FIG. 10). The press plate 47 can pivot counterclockwise as viewed in FIG. 12 against the resilience of the coil sping 49. The counterclockwise pivotal motion of the press plate 47 enables the press portion 51 to project outwardly of the transport passage 26 through the groove 52. A compression spring 53 is provided around the outer periphery of the press shaft 39 in between the slider 35 and the movable block 42 to bias the movable block 42, the arm 45 and the press plate 47 forwardly toward the press head 41. The press means that includes the slider 35 is retreatably moved forwardly by a forward moving means using the spring force. As one example of the forward moving means, a reel 54 is rotatably supported on a shaft 55 in the forward end portion of the housing comprising the frame 21 and the covers 22 and 23, and a constant-load spring 56 is wound up on the core of the reel 54 with the proximal end of the spring 56 connected to the core, the distal end of the spring 56 being led out and secured to the bottom of the slider 35. The constant-load spring 56 is bent in the direction of the width, and the load derived from the pulling force of the spring 56 is applied to the slider 35 and the associated members in a direction in which these members are moved forwardly. The constant-load spring 56 is arranged such that an enlarged-width portion 56*a* is formed at the end thereof which is secured to the slider 35 (see FIG. 7) and each of the uniform width portions provide a constant load. The slider 35 and the associated members can move backwardly against the resilience of the constant-load spring 56. As will be clear from FIGS. 4 and 9, the intermediate portion of a lock lever 57 is vertically pivotably supported through a shaft 57*a* on the rear end portion of the frame 21. The lock lever 57 is biased by a coil spring 58 such that a lock portion formed at the distal end of the lever 57 pivots downwardly. The proximal end portion of the lock lever 57 is arranged to abut against a stopper 59 provided on the frame 21 to limit the pivotal motion of the lever 57. When the distal end of the lock lever 57 is pressed by the upper portion of the rear end of the slider 35, the lever 57 is pivoted against the resilience of the coil spring 58, and when the slider 35 has passed the lock portion at the distal end of the lock lever 57, the lever 57 is pivoted to return to the original position by the repelling resilience of the coil spring 58, so that the lock portion of the lever 57 is engaged with the slider 35 to stop the forward movement of the slider 35 and the associated members. In addition, when the proximal end portion of the lock lever 57 is pushed to pivot the lever 57 against the resilience of the coil spring 58 so as to diengage the lock portion from the slider 35, the slider 35 and the associated members are moved forwardly by the pulling force from the constant-load spring 56. As the slider 35 and the associated members move forwardly, a binding band 1 in the transport passage 26 can be carried forwardly with the head portion 3 of the binding band 1 being pressed by the press plate 47.

As will be understood by specific reference to FIGS. 4, 5, 8, 9 and 10, the central portion of the bottom of the frame 21 is formed with a guide groove 60. A first hand-operated member 61 and a movable plate 62 are disposed in front of the grip 25. The movable plate 62 has a projection 63 which is provided on one side of the upper end portion of the movable plate 62. The projection 63 is inserted into the guide groove 60 so as to be supported slidably in the longitudinal direction. The upper end portion of the first hand-operated member 61 is pivotably connected to a pin 64 that projects sidewardly from the projection 63. A compression spring 65 is interposed in the guide groove 60 between the rear end face of the groove 60 and projection 63 to bias the first hand-operated member 61 and the movable plate 62 forwardly, that is, away from the grip 25. The first hand-operated member 61 has a holding frame 66 which projects rearwardly from the side of the lower portion thereof to hold the movable plate 62 so as to limit the backward movement of the movable plate 62. One end of an adjust screw shaft 67 is pivotably connected through a pin 68 to the inner side of the proximal end portion of the first hand-operated member 61, and the other end of the adjust screw shaft 67 is slidably supported by a support hole 69 in the movable plate 62. A nut 70 is screwed onto the intermediate portion of the adjust screw shaft 67. A part of the outer periphery of the nut 70 is inserted in a hole 71 that is formed in the movable plate 62. A compression spring 72 is provided around the outer periphery of the adjust screw shaft 67 in between the first hand-operated member 61 and the nut 70. Accordingly, if the user, holding the grip 25, pulls the first hand-operated member 61, this first hand-operated member 61 and the movable plate 62 can be moved backwardly against the resilience of the compression spring 65. Conversely, if the user releases the first hand-operated member 61, this first hand-operated member 61 and the movable plate 62 can be moved forwardly by the repelling resilience of the compression spring 65. If the backward movement of the movable plate 62 is stopped halfway when the first hand-operated member 61 and the movable plate 62 are moved backwardly against the resilience of the compression spring 65, the first hand-operated member 61 alone can be pivoted backwardly against the resilience of the compression spring 72, and when released, the first hand-operated member 61 can be returned forwardly by virtue of the repelling resilience of the compression spring 72. As will be clear particularly from FIGS. 4 and 5, an arm 73 projects rearwardly from the upper end of the movable plate 62, and a horizontally projecting press portion 74 is formed at the distal end of the arm 73, the press portion 74 being fitted in a groove 75 that is formed in the rear end portion of the frame 21. When the movable plate 62 moves backwardly together with the first hand-operated member 61, as described above, the press portion 74 moves backwardly along the groove 75. In consequence, the upper end portion of the lock lever 57 is pressed by the press portion 74, causing the lock lever 57 to pivot clockwise against the resilience of the coil spring 58 (see the chain line in FIG. 4), and thus allowing the lock portion at the distal end of the lock lever 57 to disengage from the slider 35. Conversely, when the movable plate 62 moves forwardly together with the first hand-operated member 61, the lock lever 57 is released and allowed to pivot counterclockwise by virtue of the resilience of the coil spring 58 (see the solid line in FIG. 4).

Figure 4:
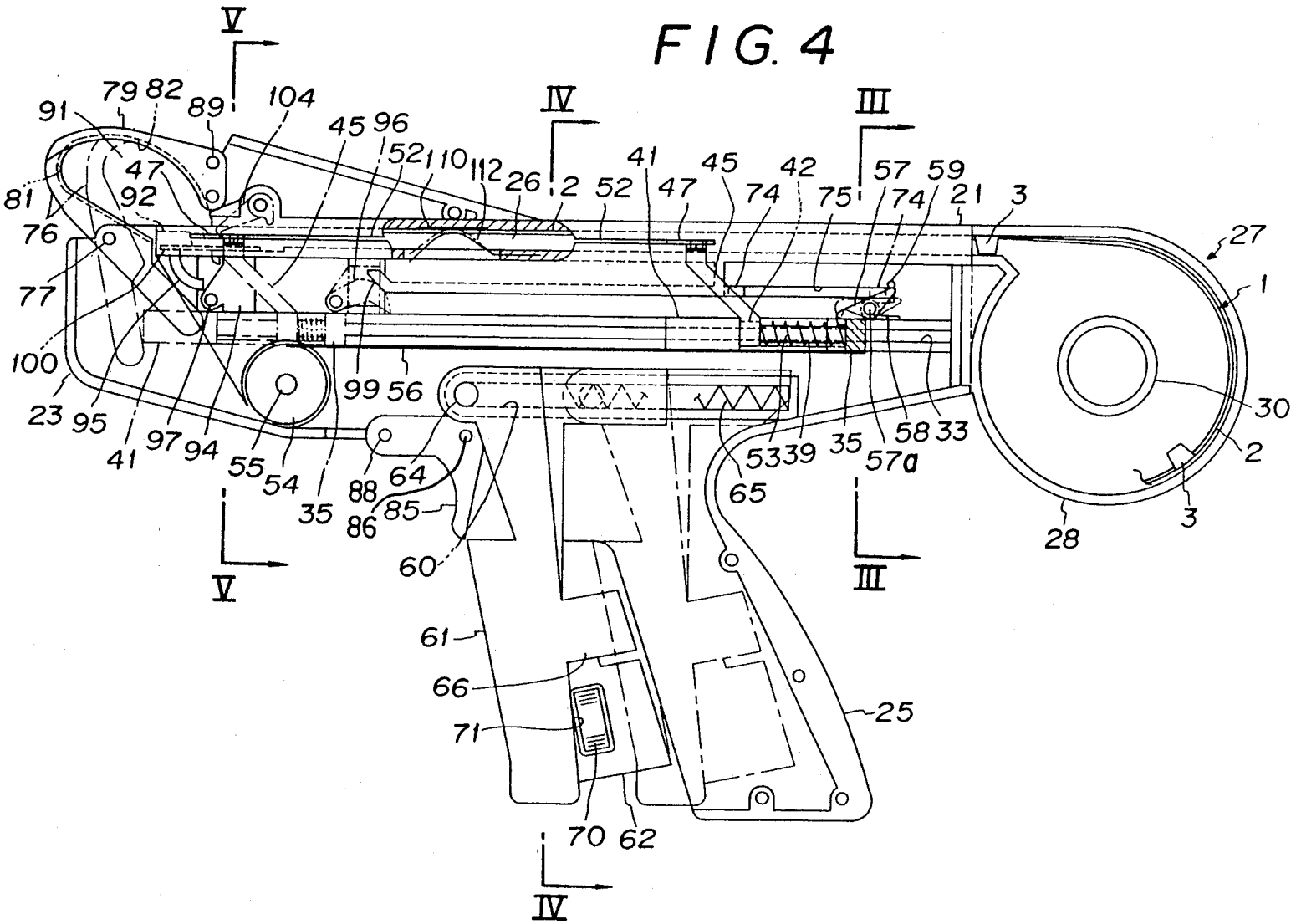
Figure 5:
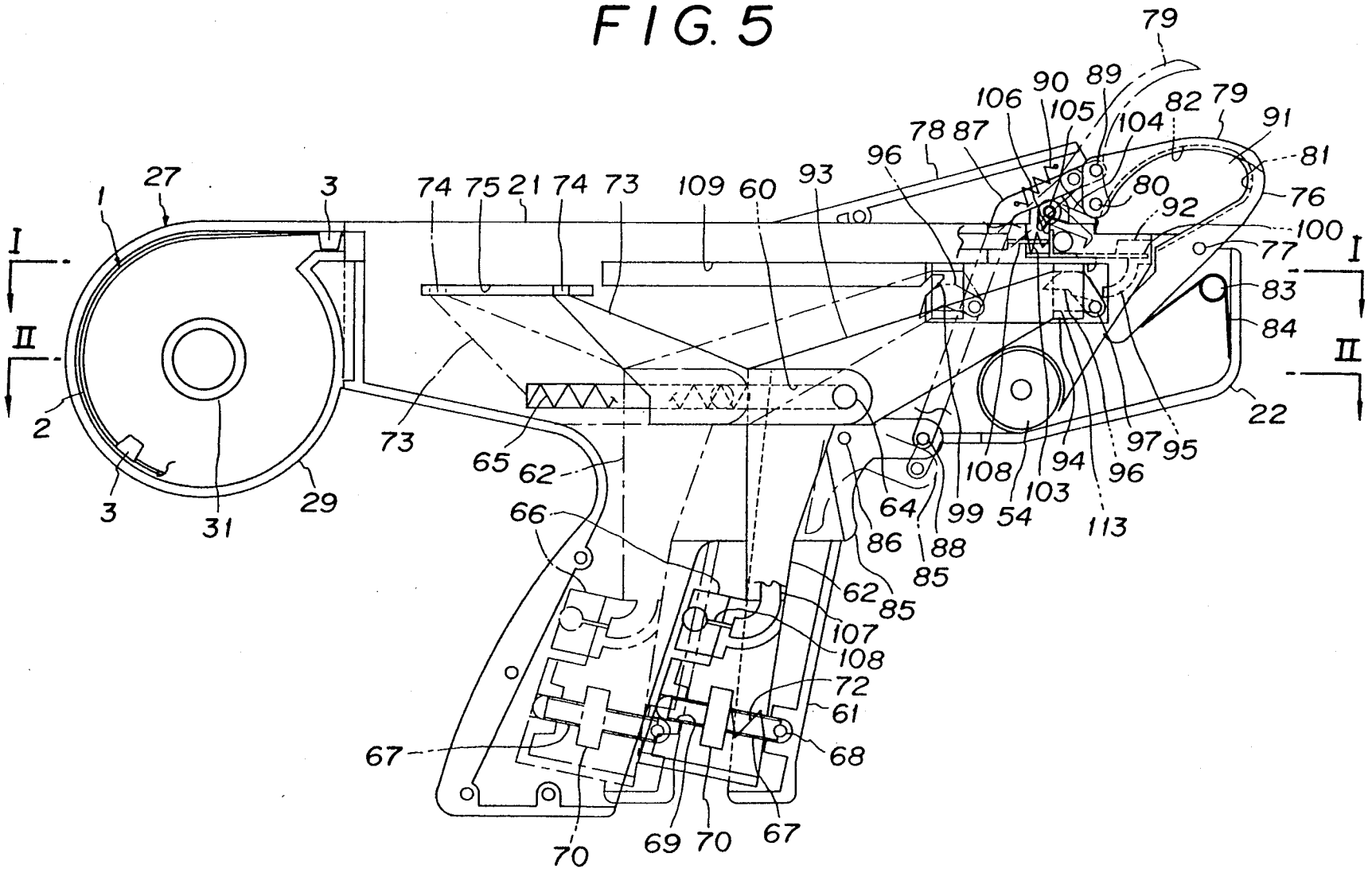

As will be clear from FIGS. 1 to 6, particularly FIGS. 4 and 5, the intermediate portion of a first guide member 76 is pivotably supported through a shaft 77 on the forward end portion of the frame 21, and the proximal end portion of a second guide member 79 is pivotably supported through a shaft 80 on a support portion 78 that projects upwardly from a position of the housing comprising the covers 22 and 23, which is a little closer to the forward end than the middle of the housing. The first and second guide members 76 and 79 are opened and closed by a manual drive means. The respective portions of the first and second guide members 76 and 79 that project outwardly from the frame 21 each have a bow-shaped configuration and are combined together in such a manner as to be capable of being opened and closed. The first and second guide members 76 and 79 have guide grooves 81 and 82 formed in the respective inner surfaces. A coil spring 84 is wound around a shaft 83 that projects sidewardly from the forward end portion of the frame 22 within the housing. One end of the coil spring 84 is retained by the first guide member 76, and the other end of the coil spring 84 by the frame 22, thereby enabling the first guide member 76 to be held in the solid-line position shown in FIGS. 4 and 5. The elbow portion of a second hand-operated member 85 is pivotably supported through a shaft 86 on the frame 21 at a position forwardly of the grip 25. Both ends of a link 87 are pivotably connected to the distal end portion of the second hand-operated member 85 and the proximal end portion of the second guide member 79 through shafts 88 and 89, respectively. The second guide member 79 is held in the solid-line position shown in FIGS. 4 and 5 by the resilience of a tension spring 90. Thus, the first and second guide members 76 and 79 cooperate with each other to define a space 91 for accommodating objects to be bound. The band portion 2 of a binding band 1 that is carried along the transport passage 26 is first guided by the guide groove 81 in the first guide member 76 and then guided by the guide groove 82 in the second guide member 79, thus bending the band portion 2 in the form of a loop by the cooperation of the first and second guide members 76 and 79. The outlet of the guide groove 82 in the second guide member 79, that is, the proximal end portion of the second guide member 79, is formed to extend the transport passage with a right angle direction along the prolongation of the center line of the hole 7 in the head portion 3 of the binding band 1 transported. A stopper 92 is provided at the forward end of the transport passage 26. The stopper 92 stops the head portion 3 of the binding band 1 carried through the transport passage 26 and holds it in position (see the chain line in FIG. 5). The stopper 92 is set so that the band portion 2 is guided by the guide grooves 81 and 82 in the first and second guide members 76 and 79 and thereby bent in the form of a loop, while the head portion 3 is positioned directly below the outlet of the guide groove 82, that is, directly below the distal end of the band portion 2 that is located in the outlet of the guide groove 82. By pivoting the second hand-operated member 85 against the resilience of the tension spring 90, as shown by the chain line in FIG. 5, the second guide member 79 is pivoted counterclockwise to seperate from the first guide member 76, thereby enabling the space 91 to be opened to the outside. When the above-described state, in which the band portion 2 is bent by being guided along the guide grooves 81 and 82 in the first and second guide members 76 and 79 and the head portion 3 is positioned by the stopper 92, is reached, the forward movement of the press plate 47, the arm 45 and the movable block 42 is stopped, as shown by the chain line in FIG. 4. However, since the enlarged-width portion **56*a* of the constant-load spring 56 (see FIG. 7) is located between the reel 54 and the slider 35, the load derived from the pulling force increases, so that the slider 35, the press shaft 39, the connecting plate 40 and the press head 41 can be moved forwardly against the resilience of the compression spring 53. As these members move forwardly, the proximal end portion of the first guide member 76 is pressed by the press head 41, causing the first guide member 76 to pivot clockwise as viewed in FIG. 4 against the resilience of the coil spring 84, and thus reducing the space 91. As the space 91 is reduced, the loop of the band portion 2 is also reduced, so that the forward end of the band portion 2 can be inserted into the hole 7 in the head portion 3 held in position by the stopper 92. When the press head 41 and the associated members move backwardly, the first guide member 76 is pivoted to return to the original position by the repelling resilience of the coil spring 84**.

Figure 11:
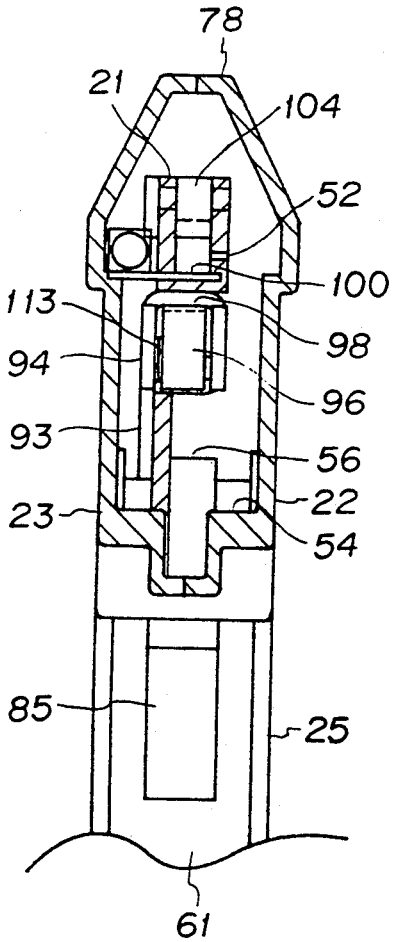
Figure 12:
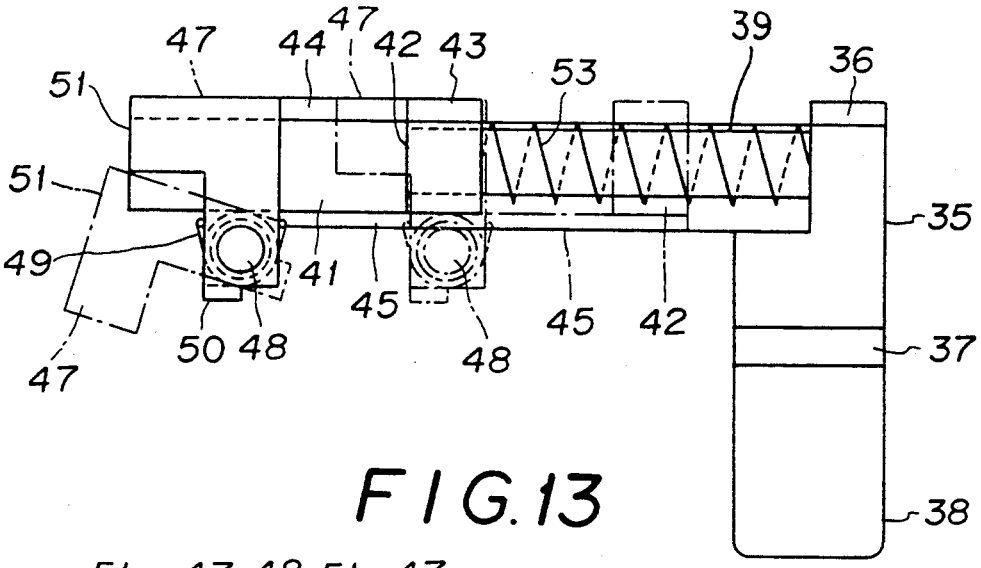
Figure 13:
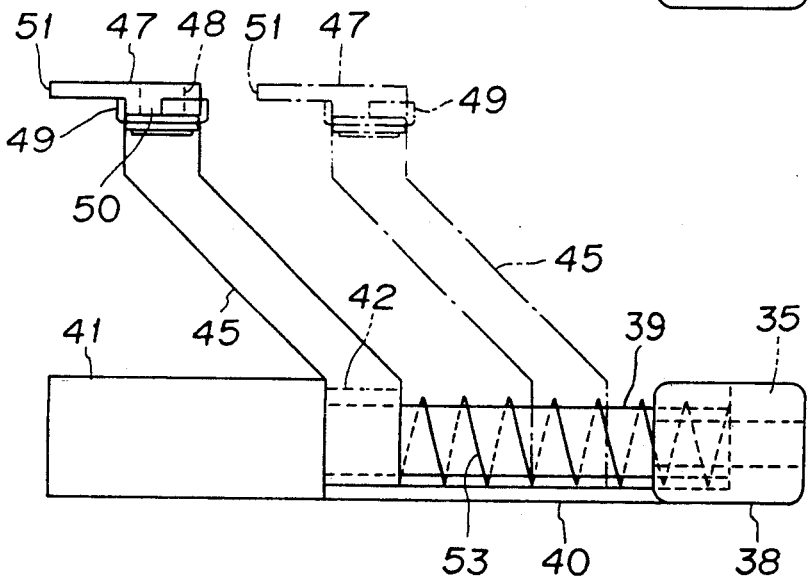

As will be clear particularly from FIGS. 4, 5 and 11, a manual stretching means is provided for tensely pulling the end portion of the band portion 2 of the binding band 1 that projects from the head portion 3. An arm 93 projects forwardly from the upper end of the movable plate 62, and a frame shaped portion 94 is integrally provided at the distal end of the arm 93. The forward end portion of the band portion 2 of the binding band 1 that projects from the head portion 3 is inserted into the frame shaped portion 94 through a guide plate 95. The proximal end portion of a stretching member 96 is rotatably supported through a shaft 97 inside the frame-shaped portion 94, the stretching member 96 having a plurality of teeth 98 formed on the distal end portion thereof. The stretching member 96 is biased by a coil spring 113 such that the teeth 98 are pressed toward the upper surface of the frame-shaped portion 94. Thus, the band portion 2 that is inserted into the frame-shaped portion 94 can be pressed against the upper surface of the frame-shaped portion 94 by the stretching member 96 so that the teeth 98 are engaged with the engagement portions 4 of the band portion 2. Accordingly, the band portion 2 can be stretched by moving the movable plate 62 backwardly, as described above. The frame 21 is formed with a slant surface 99 in the rear of the stretching member 96 so that, after the band portion 2 has been stretched, the slant surface of the distal end portion of the stretching member 96 is engaged with the slant surface 99, thereby enabling the stretching member 96 to be released from the band portion 2.

Figure 6:
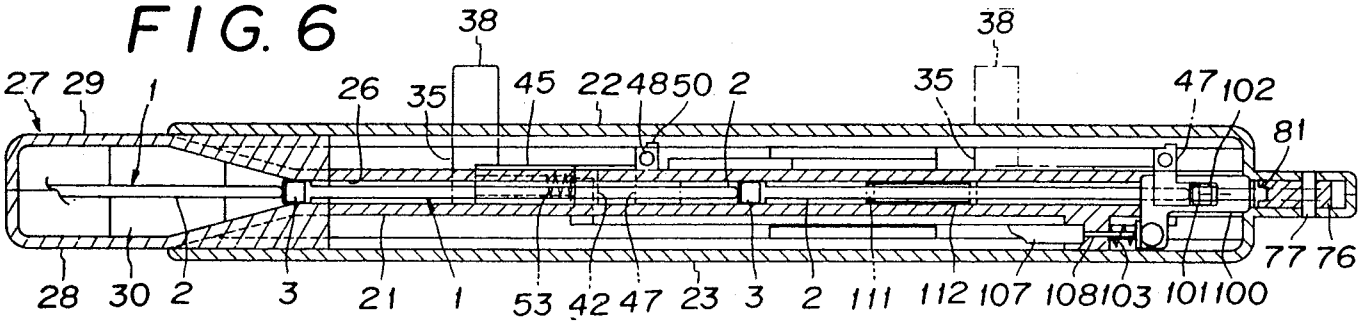
Figure 7:
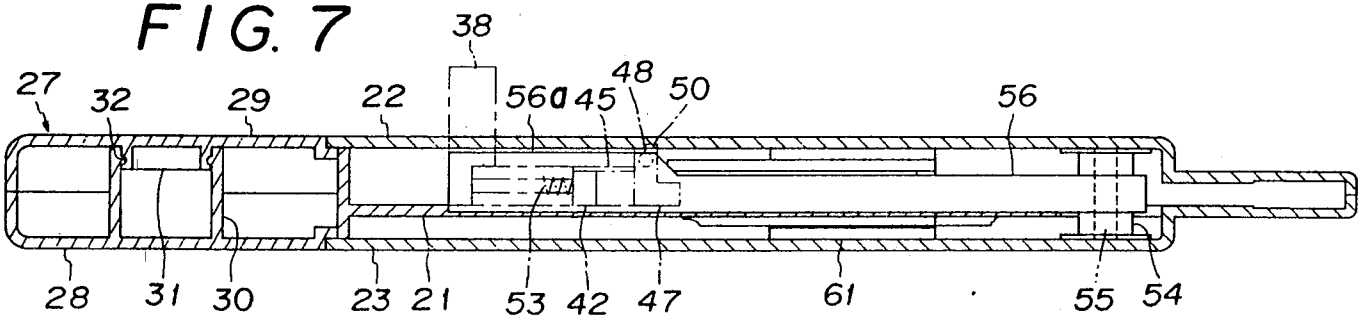
Figure 8:
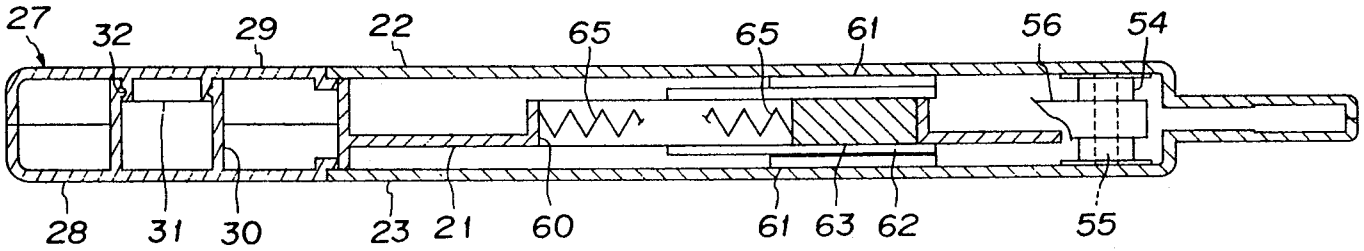
Figure 9:
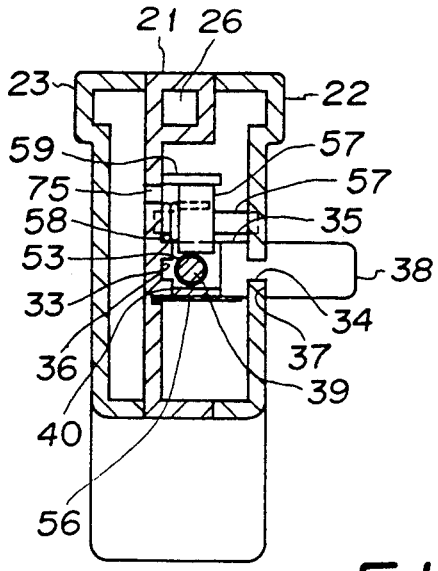
Figure 10:
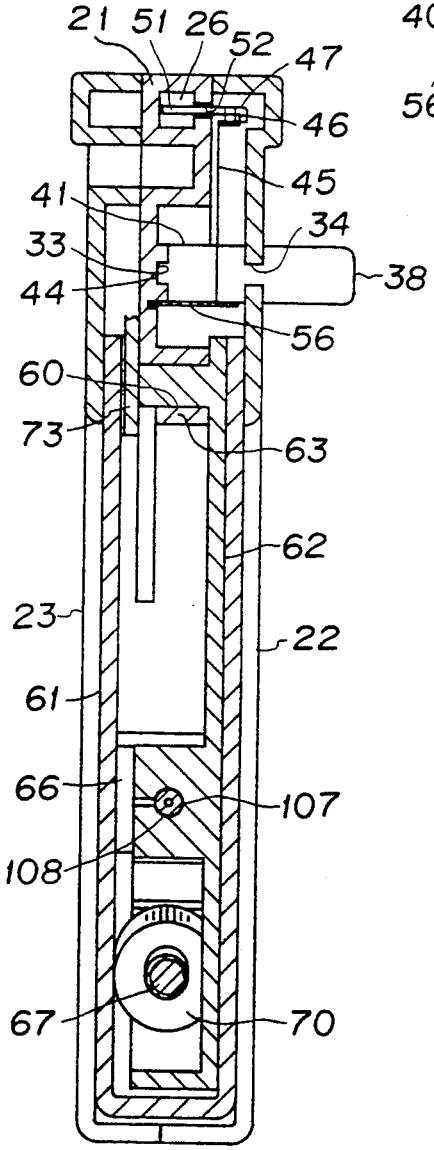

As shown in FIG. 4 to 6, the hand-operated binding device is provided with a manual cutting means for cutting off the forward end portion of the band portion 2 of the binding band 1 that projects from the head portion 3 after the objects have been bound with the binding band 1, and a manual cutting means for cutting off the binding band 1, after the objects have been bound therewith, from the following binding band 1 at the back of the head portion 3 of the former. A cutter 100 (hereinafter referred to as "first cutter") for cutting off the projecting end portion of the band portion 2 is longitudinally slidably supported on the upper side of the forward end portion of the frame 21. The first cutter 100 has a hole 101 formed in the center. The hole 101 has a cutting edge 102 formed along its forward edge. The first cutter 100 is arranged such that, when it is moved to a forward position by the action of a compression spring 103, the band portion 2 of the binding band 1 that projects from the head portion 3 is inserted into the hole 101. When the first cutter 100 moves backwardly against the resilience of the compression spring 103, the band portion 2 projecting from the hole 101 is cut off along the head portion 3 by the cutting edge 102. A cutter 104 (hereinafter referred to as "second cutter") for cutting off the binding band 1 from the following binding band 1 is pivotably supported at the intermediate portion thereof through a shaft 105 on the frame 21 above the first cutter 100. The second cutter 104 is biased by a coil spring 106 such that a cutting edge that is formed at the distal end of the second cutter 104 is pivoted upwardly. The proximal end portion of the second cutter 104 is engaged with the proximal end portion of the first cutter 100 to prevent the second cutter 104 from pivoting more than a predetermined angle and to retain it in such a manner as to permit passage of the binding band 1. When the first cutter 100 moves backwardly against the resilience of the compression spring 103, the cutting edge at the distal end of the second cutter 104 pivots downwardly against the resilience of the coil spring 106 to cut the connecting portion 15 behind the head portion 3 of the top binding band 1 which is in a binding state, thereby enabling the former to be cut off the latter. Both end portions of a cable sheath 107, as a connecting means, are secured to a portion of the movable plate 62 of the side thereof which is closer to the holding frame 66 of the first hand-operated member 61 and to the rear end portion of the first cutter 100 on the frame 21. One end of a wire 108 that is slidable inside the cable sheath 107 is connected to the rear side plate of the holding frame 66 of the first hand-operated member 61, and the other end of the wire 108 is connected to the proximal end portion of the first cutter 100. Accordingly, when the backward movement of the movable plate 62 stops when the first hand-operated member 61 is moved backwardly, together with the movable plate 62, against the resilience of the compression spring 72, the first hand-operated member 61 is further moved backwardly against the resilience of the compression spring 72. Thus, the wire 108 is pulled to move the first cutter 100 backwardly against the resilience of the compression spring 103, and it is also possible to pivot the second cutter 104 against the resilience of the coil spring 106. If the nut 70 is rotated in the desired direction, the first hand-operated member 61 is brought close to the movable plate 62 against the resilience of the compression spring 72, or the first hand-operated member 61 is moved away from the movable plate 62 by the resilience of the compression spring 72, thereby enabling adjustment of the pulling force applied to the first and second cutters 100 and 104 by the wire 108. The cover 23 is formed with a discharge opening 109 for discharging the cut piece of the band portion 2.

Figure 14:
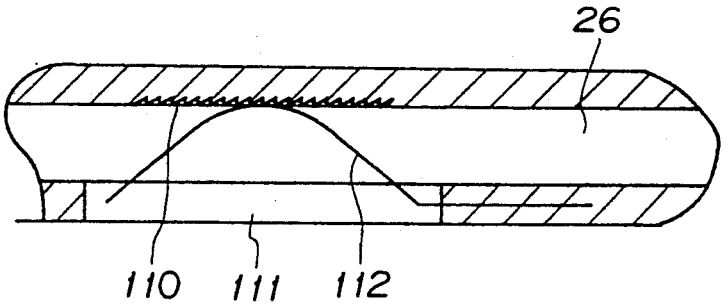

As shown in FIGS. 4 and 14, the intermediate portion of the transport passage 26 is provided with a means for stopping the backward movement of the following binding band 1 cut off from the preceding one. As one example of this means, a row of sawtooth engagement projections 110 are provided on the lower (inner) surface of the upper wall of the transport passage 26 along the direction of transport of a series of binding bands 1. As will be clear particularly from FIG. 14, each engagement projection 110 comprises a substantially vertical front surface, which serves as an engagement surface, and a gently slant rear surface. The bottom of the transport passage 26 is formed with a hole 111 in facing relation to the engagement projections 110. The proximal end portion of a plate spring 112 is rigidly inserted into the rear edge portion of the hole 111, with the forward end portion of the spring 112 projecting toward the engagement projections 110. Accordingly, when the binding band 1 is moved toward the guide members 76 and 79, even if the binding band 1 is pressed against the engagement projections 110 by the plate spring 112, the engagement portions 4 of the band portion 2 can pass the engagement projections 110 freely since the rear surfaces of the engagement projections 110 are gently slanted. However, since the front surfaces of the engagement projections 110 are substantially vertical, the backward movement of the binding band 1 toward the cartridge 27 is prevented by the engagement between the engagement portions 5 and the front surfaces of the engagement projections 110. Thus, when the slider 35 and the associated members move backwardly and the press plate 47 comes into contact with the head portion 3 of the binding band 1, the backward movement of the binding band 1 is prevented and the press plate 47 is pivoted counterclockwise against the resilience of the coil spring 49 (see FIG. 12), thus enabling the head portion 3 to be bypassed.

The following is a description of one cycle of the binding operation of the hand-operated binding device with the foregoing arrangement.

First, as shown in FIGS. 4 to 6, the cartridge 27 with the top binding band 1 projecting therefrom is attached to the rear end of the housing comprising the covers 22 and 23, and the top binding band 1 is fed into the transport passage 26. Next, with the whole device held by gripping the grip 25, the user operates the operating portion 38 to move backwardly the slider 35, the press head 41, the movable block 42, the arm 45, the press plate 47, etc. while unwinding the constant-load spring 56 from the reel 54. At this time, the press plate 47 bypasses the head portion 3. More specifically, when the press plate 47 comes into contact with the head portion 3, since the binding band 1 is pressed against the engagement projections 110 by the plate spring 112 and the engagement portions 5 are locked by the engagement projections 110 so as to prevent the backward movement, the press plate 47 pivots counterclockwise against the resilience of the coil spring 49 (see FIG. 12) to pass the head portion 3. After passing the head portion 3, the press plate 47 is pivoted clockwise to return to the original position by the repelling resilience of the coil spring 49, thereby being positioned behind the head portion 3. When the slider 35 and the associated members further move backwardly, the distal end portion of the lock lever 57 is pressed, causing the lock lever 57 to pivot clockwise as viewed in FIG. 4 against the resilience of the coil spring 58, as described above. After the slider 35 has passed the lock portion of the lock lever 57, the lock lever 57 is pivoted counterclockwise by the repelling resilience of the coil spring 58, so that the lock portion of the lock lever 57 engages the front surface of the slider 35 to retain the slider 35 and the associated members at the respective backward positions.

Upon completion of the preparation for binding, the second hand-operated member 85 is pivoted against the resilience of the tension spring 90 to pivot the second guide member 79 counterclockwise through the link 87, as shown by the chain line in FIG. 5, thereby opening the space 91 to the outside. Next, a bundle of electric wires 18 (see FIG. 21), as objects to be bound, is inserted into the space 91, and the second hand-operated member 85 is released. In consequence, the second hand-operated member 85, the second guide member 79, etc. are returned to the respective original positions by the resilience of the tension spring 90, resulting in the space 91 being closed. Next, the first hand-operated member 61 and the movable plate 62 are moved backwardly against the resilience of the compression spring 65 so that the press portion 74 of the arm 73 moves backwardly along the groove 75 to pivot the lock lever 57 clockwise as viewed in FIG. 4 against the resilience of the coil spring 58, causing the lock portion at the distal end of the lock lever 57 to disengage from the slider 35, resulting in it being able to unlock. In consequence, the slider 35, the press head 41, the movable block 42, the arm 45, the press plate 47, etc. are rapidly moved forwardly by the rewinding force of the constant-load spring 56. Thus, the press plate 47 at the distal end of the arm 45 presses the head portion 3 of the top binding band 1 from the rear side, thus transporting this binding band 1 forwardly, together with the binding bands 1 following it. The band portion 2 of the top binding band 1 is bent in the form of a loop along the guide grooves 81 and 82 in the first and second guide members 76 and 79. The head portion 3 of this binding band 1 abuts against the stopper 92 and is thereby held in position so that the distal end of the band portion 2 faces the hole 7 in the head portion 3. Thus, the press plate 47, the arm 45 and the movable block 42 are stopped from moving forwardly. However, the slider 35 and the press head 41, which is connected to the slider 35 by the press shaft 39 and the connecting plate 40, are further moved forwardly against the resilience of the compression spring 53 by virtue of the rewinding force of the enlarged-width portion 56*a* of the constant-load spring 56 (see FIG. 7), causing the first guide member 76 to pivot clockwise against the resilience of the coil spring 84, and thereby reducing the space 91. Thus, since the head portion 3 is retained in position by the stopper 92, the loop of the band portion 2 can be reduced, thus enabling the distal end portion of the band portion 2 to be passed through the hole 7 by an amount corresponding to the reduction in the loop of the band portion 2. The distal end portion of the band portion 2 that projects from the head portion 3 is inserted into the frame-shaped portion 94 through the guide plate 95.

During this time, the first hand-operated member 61 is released to allow this first hand-operated member 61 and the movable plate 62 to move forwardly by the repelling resilience of the compression spring 65, thereby pressing the band portion 2 against the upper surface of the frame-shaped portion 94 by the stretching member 96 by utilization of the resilience of the coil spring 113, and engaging the teeth 98 of the stretching member 96 with the engagement portions 4 of the band portion 2. Next, the first hand-operated member 61 and the movable plate 62 are moved backwardly against the resilience of the compression spring 65, as described above. In consequence, the stretching member 96 also moves backwardly, stretching the band portion 2 backwardly, thereby enabling the bundle of electric wires 18 to be bound with the loop of the band portion 2, as shown in FIG. 19. In a case where the desired binding form cannot be obtained by a single operation of the first hand-operated member 61, the first hand-operated member 61, the movable plate 62, the stretching member 96, etc. are moved backwardly to engage the slant surface at the distal end of the stretching member 96 with the slant surface 99 of the frame 21 and to pivot the stretching member 96 against the resilience of the coil spring 113, thereby releasing the band portion 2. Thereafter, the first hand operated member 61 is released to allow this first hand-operated member 61, the movable plate 62, the stretching member 96, etc. to move forwardly by the repelling resilience of the compression spring 65. At this time, in a state where the band portion 2 of the binding band 1 has been passed through the hole 7 in the head portion 3, the engagement portions 4 and 5 are locked by the locking projections 12 and 13 to prevent the band portion 2 from coming off the head portion 3, and when the stretching member 96 moves forwardly, the locking projections 12 and 13 allow the band portion 2 to pass therethrough without cutting into it. Therefore, by repeatedly operating the first hand-operated member 61, the desired binding form can be obtained.

When the binding band 1 is fastened tight in this way and hence the resistance to the backward movement of the stretching member 96 and the movable plate 62 increases, the backward movement of the movable plate 62 and the associated members stops. Then, the first hand-operated member 61 is pivoted backwardly against the resilience of the compression spring 72 to pull the wire 108 so as to move the first cutter 100 backwardly against the resilience of the compression spring 103 and cause the second cutter 104 to pivot clockwise, as shown by the chain line in FIG. 5, against the resilience of the coil spring 106. Thus, the band portion 2 is cut along the head portion 3 by the cutting edge 102 of the first cutter 100, and the connecting portion 15 behind the head portion 3 is cut by the second cutter 104 to thereby cut off the binding band 1 from the following binding band 1. As a result of this cutting operation, the resistance that has been acting on the stretching member 96 and the movable plate 62 disappears and hence these members are moved backwardly by the repelling resilience of the compression spring 72 to transfer the cut piece of the band portion 2 to the discharge opening 109. The backward movement of the stretching member 96 causes the slant surface at the distal end thereof to engage the slant surface 99 of the frame 21 and to pivot the stretching member 96 against the resilience of the coil spring 113, thereby releasing the cut piece of the band portion 2. Thus, the cut piece of the band portion 2 can be discharged to the outside from the discharge opening 109. Next, the first hand-operated member 61 is released to allow this first hand-operated member 61, the movable plate 62 and the stretching member 96 to move forwardly by the repelling resilience of the compression spring 65, and the first and second cutters 101 and 104 ar returned to the respective original positions by the repelling resilience of the compression spring 103 and the coil spring 106.

Upon completion of the first binding operation, the operating portion 38 is operated to move backwardly the slider 35, the press head 41, the movable block 42, the arm 45, the press plate 47, etc. while unwinding the constant-load spring 56 from the reel 54, in the same way as the above. At this time, the press plate 47 bypasses the head portion 3 of the binding band 1 so as to be positioned behind the head portion 3 to stand by for the next binding operation, in the same way as the above.

By repeating the above-described operation the binding work can be conducted successively. Finally, the second hand-operated member 85 is pivoted against the resilience of the tension spring 90 to pivot the second guide member 79 through the link 87, thereby opening the space 91, and thus enabling the bound bundle of electric wires 18 to be released, as stated above.

As has been described above, according to this embodiment, the means for transporting the binding band 1 is manually operated, the drive means for opening and closing the first and second guide members 76 and 79 are also manually operated, and further the means for stretching the band portion 2 is manually operated. There is therefore no need for attached equipment such as a compressed air supply source and a power source, which have heretofore been needed in the prior art. Thus, it is possible to eliminate the limitation on the place where the binding device is usable and hence possible to obtain general-purpose properties.

Next, a second embodiment of the hand-operated binding device according to the present invention will be described with reference to FIG. 15.

This embodiment is suitable for use in a case where a young plant, for example, is tied to a support piece of wood with a binding band 1 with room for the plant to grow freely. In this embodiment, the same portions or elements as those in the first embodiment are denoted by the same reference numerals and description thereof is omitted. Thus, only an arrangement which is different from the first embodiment will be explained below.

Figure 15:
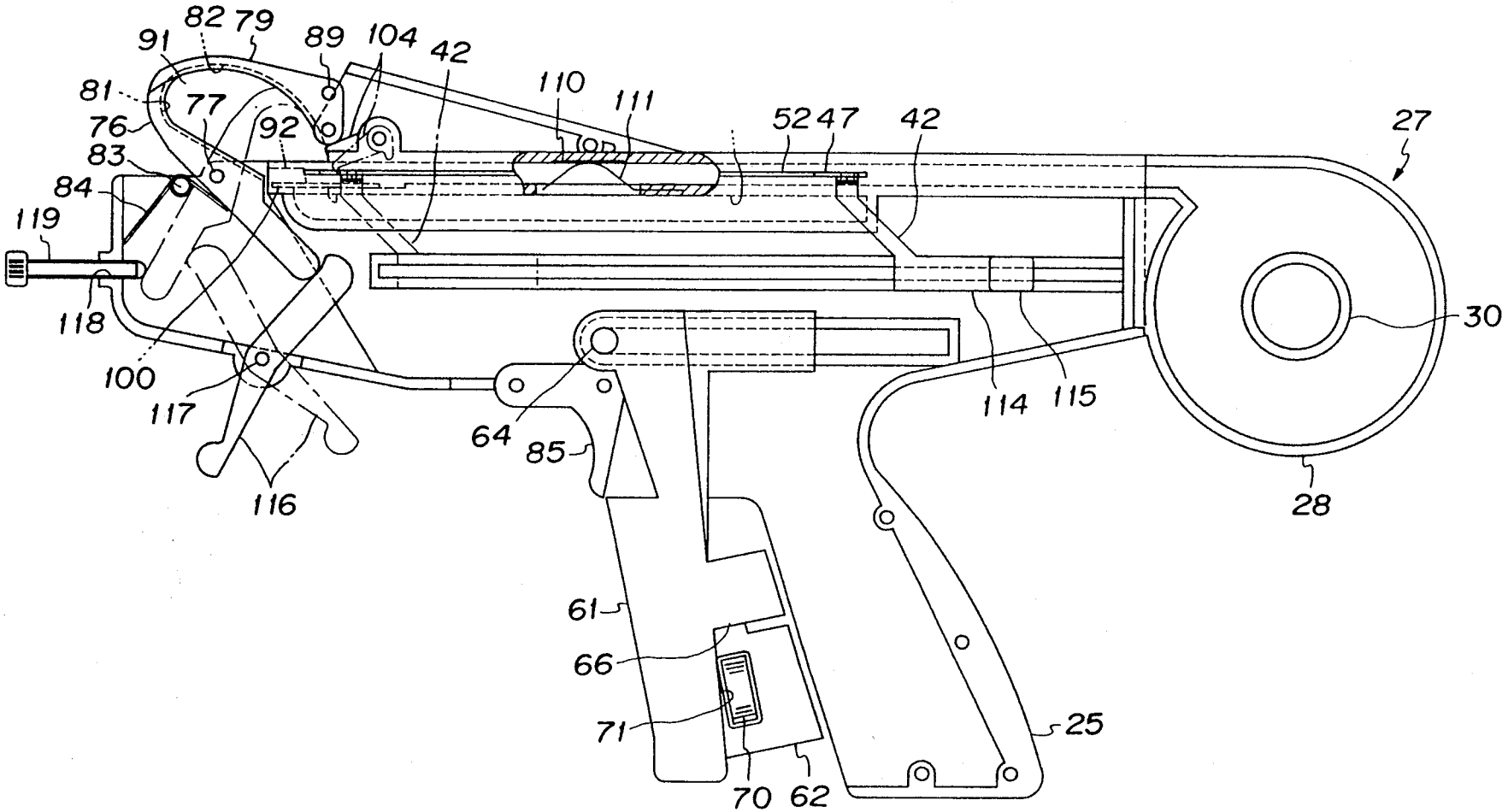
FIG. 15 is a partly-cutaway front view of a second embodiment of the hand-operated binding device according to the present invention, with a front cover removed therefrom.

As shown in FIG. 15, a movable block 114 is supported in such a manner as to be movable along the guide groove 33 in the frame 21 and the guide groove (not shown) of the cover. The movable block 114 has an operating portion 115 projecting outwardly from the cover. The proximal end portion of the arm 45 is attached to the side surface of the movable block 114, and the press plate 47 is supported on the distal end of the arm 45, in the same way as in the first embodiment. By manually operating the operating portion 115, the movable block 114, the arm 45, the press plate 47, etc. are moved forwardly or backwardly. The movable plate 62 is secured to the frame 21, and the first hand-operated member 61 is pivotably connected to the pin 64 of the movable plate 62. The holding frame 66 of the first hand-operated member 61 is connected to the first cutter 100 by a wire (not shown). The first guide member 76 is supported in such a manner as to be capable of pivoting within a larger angle range than in the first embodiment, thereby making it possible to further reduce the space 91 defined by the first and second guide members 76 and 79 for accommodating objects to be bound. A third hand-operated member 116 is pivotably supported through a shaft 117 on the frame 21 such that the first guide member 76 is pivoted by the third hand-operated member 116 in the direction (clockwise) in which the space 91 is reduced, against the resilience of the coil spring 84. A tapped hole 118 is formed in the forward end of the frame 21, and an adjust screw shaft 119 is screwed into the tapped hole 118. By adjusting the amount to which the adjust screw shaft 119 projects inside the frame 21, the angle of pivoting of the first guide member 76, that is, the degree to which the space 91 is reduced, is adjusted.

One cycle of the binding operation of the second embodiment with the foregoing arrangement will be explained below.

First, the cartridge 27 with the top binding band 1 projecting therefrom is attached to the rear end of the housing comprising the covers 22 and 23 (see FIG. 4), and the top binding band 1 is fed into the transport passage 26. Next, with the whole device held by gripping the grip 25, the user operates the operating portion 115 to move backwardly the movable block 114, the arm 45, the press plate 47, etc., as described above. At this time, the press plate 47 bypasses the head portion 3 by utilization of the coil spring 49 (see FIG. 12) so as to be positioned behind the head portion 3.

Upon completion of the preparation for binding, the second hand-operated member 85 is pivoted to cause the second guide member 79 to pivot counterclockwise, thereby opening the space 91 to the outside (see the chain line in FIG. 5), in the same way as in the first embodiment. Next, objects to be bound, for example, a young plant and a support piece of wood (not shown), are inserted into the space 91, and then the second hand-operated member 85 is released to return the second guide member 79 and the associated members to the respective original positions, thereby closing the space 91. Next, the movable block 114, the arm 45, the press plate 47, etc. are moved forwardly by manually operating the operating portion 115. In consequence, the press plate 47 presses the head portion 3 of the top binding band 1 from the rear side, thus transporting this binding band 1 forwardly, together with the binding bands 1 following it. The band portion 2 of the top binding band 1 is bent in the form of a loop along the guide grooves 81 and 82 in the first and second guide members 76 and 79. The head portion 3 of this binding band 1 abuts against the stopper 92 and is thereby held in position so that the distal end of the band portion 2 faces the hole 7 in the head portion 3. Next, the third hand-operated member 116 is manually operated to pivot counterclockwise, causing the first guide member 76 to pivot clockwise against the resilience of the coil spring 84, and thus reducing the space 91. Then, the band portion 2 is inserted into the hole 7 in the head portion 3 held in position by the stopper 92, thereby reducing the loop. At this time, the proximal end portion of the first guide member 76 abuts against the adjust screw shaft 119 to limit the pivoting of the first guide member 76, that is, the reduction of the space 91, thereby limiting the degree to which the loop of the binding band 1 is reduced, and thus enabling the young plant and the support piece of wood to be loosely bound with the binding band 1. By adjusting the length at which the adjust screw shaft 119 projects inside the frame 21, as described above, the young plant and the support piece of wood can be bound with desired room.

After the objects have been bound with the binding band 1, the third hand-operated member 116 is released to return the first guide member 76 to the original position by the repelling resilience of the coil spring 84. Next, the first hand-operated member 61 is pivoted backwardly against the resilience of the compression spring 72 (see FIG. 5) to pull the wire 108 so as to move the first cutter 100 backwardly against the resilience of the compression spring 103 and allow the second cutter 104 to pivot against the resilience of the coil spring 106, in the same way as in the first embodiment. Thus, the band portion 2 is cut along the head portion 3 by the first cutter 100, and the connecting portion 15 behind the head portion 3 is cut by the second cutter 104 to thereby cut off the binding band 1 from the following binding band 1. The cut piece of the band portion 2 can be discharged from the discharge opening 109. Next, the first hand-operated member 61 is released to allow it to move forwardly by the repelling resilience of the compression spring 72, and the first and second cutters 101 and 104 are returned to the respective original positions by the repelling resilience of the compression spring 103 and the coil spring 106.

Upon completion of the first binding operation, the operating portion 115 is operated to move backwardly the movable block 114, the arm 45, the press plate 47, etc., thus causing the press plate 47 to bypass the head portion 3 of the binding band 1 so as to be positioned behind the head portion 3 to stand by for the next binding operation, in the same way as the above.

By repeating the above-described operation, the binding work can be conducted successively.

Since this embodiment needs no means for manually stretching the binding band 1 such as that in the first embodiment, it is possible to simplify the arrangement.

A third embodiment of the hand-operated binding device according to the present invention will be explained with reference to FIG. 16.

Figure 16:
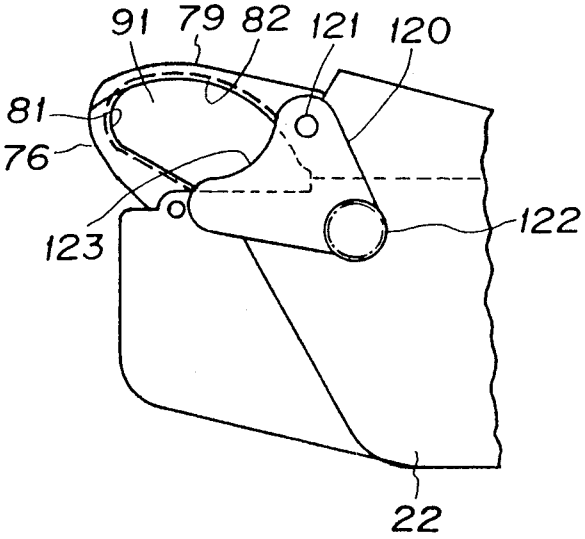
FIG. 16 is a front view of an essential part of a third embodiment of the hand-operated binding device according to the present invention.
Figure 17:
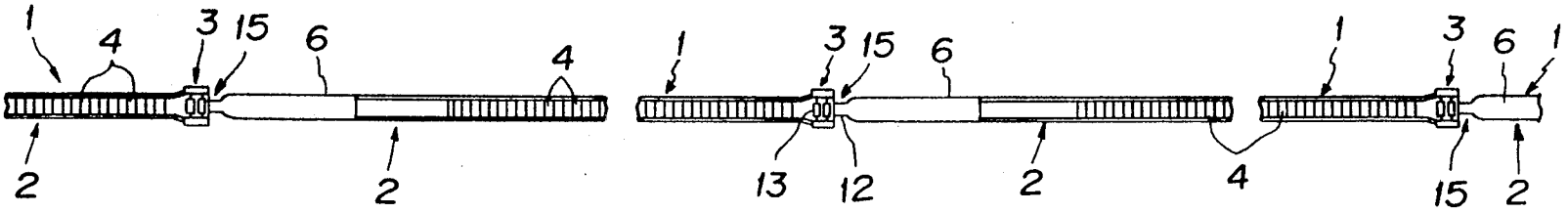

As shown in FIG. 16, a limit member 120 is pivotably supported through a shaft 121 on the forward end portion of the cover 22. A cone disc spring or a known click means (not shown) is interposed between the cover 22 and the limit member 120 to set the limit member 120 at any desired position of the pivotal motion. The limit member 120 has a knob 122 attached thereto for manually pivoting the limit member 120. Thus, by pivoting the limit member 120 with the knob 122, the size of the space 91 can be adjusted by a circular limiting portion 123 of the limit member 120. Accordingly, the position of objects to be bound is defined with the limiting portion 123 to limit the reduction of the loop of the binding band 1, thereby enabling objects, for example, a young plant and a support piece of wood, to be loosely bound with the binding band 1.

In this embodiment, since the position of objects to be bound is defined with the limiting portion 123, either the binding band 1 may be stretched to bind the objects as in the first embodiment or the loop of the binding band 1 may be reduced by the pivotal motion of the first guide member 76 alone. The arrangement of the rest of this embodiment is the same as that of the first and second embodiments.

Although in the first embodiment a bundle of electric wires 18 is fastened tight with the binding band 1 and in the second and third embodiments a young plant and a support piece of wood are loosely bound with the binding band 1, it is also possible to bind objects in such a manner that the objects are not fastened tight and yet they will not separate from each other. In such a case, it is possible to eliminate the need for the manual stretching means and the limiting means. Although in the foregoing embodiments both sides of the band portion 2 of the binding band 1 are formed with the engagement portions 4 and 5 and the head portion 3 is provided with a pair of locking projections 12 and 13 for locking the engagement portions 4 and 5, it should be noted that either of the engagement portions 4 and 5 and the corresponding locking projection 12 or 13 may be omitted. In addition, although in the foregoing embodiments a binding band roll comprising binding bands 1 connected in series longitudinally and wound up longitudinally is accommodated in the cartridge 27, which is interchangeably attached to the rear end of the housing comprising the covers 22 and 23 to feed the binding bands 1 from the rear side, the arrangement may be such that a cartridge accommodating a row of binding bands 1 which are arranged side by side is interchangeably attached to the side of the cover 22 to feed the binding bands 1 from the side of the device. In this case, a transport means, a manual cutting means for cutting off a binding band 1 from the following one, and a means for stopping the backward movement of the binding band 1 should be provided in between the cartridge and the transport passage 26, and it is unnecessary to provide the backward movement stopping means in the transport passage 26 and the second cutter 104. In addition, the binding band 1 may be fed in a state where it has been cut off from the following one in advance even in the case where it is fed from the side of the device, not to mention the case where it is fed from the rear side. In such a case, there is no need for a manual cutting means for cutting off the binding band 1 from the following one. In the field of agriculture, for example, it may be unnecessary to cut off the distal end portion of the band portion 2 that projects from the head portion 3; in this case, the first cutter 100 is not needed. The means for pressing the binding band 1 and the means for pressing the first guide member 76 may be moved either together by the common moving means as in the first embodiment or separately from each other as in the second embodiment. In addition, the present invention may be variously changed or modified in design without departing from the fundamental technical idea thereof.

What is claimed is:

1. A hand-operated binding device comprising:

a manual transport means for transporting a binding bind by a manual pressure operation, said binding band comprising a band portion with engagement portions and a head portion with a hole and a locking projection;

a pair of first and second guide members capable of opening, closing, and reducing a space for accommodating an object to be bound, said guide members being arranged to guide the band portion of said binding band when being transported by said transport means such that said band portion is bent around said object and passed through said hold in said head portion by elastic deformation of said locking projection; and a manual driving means for driving by a manual pressure operation at least one of said first and second guide members such that said space can be opened, closed and reduced; and wherein at least one of said transport means and said driving means are driven by the release of a locked, compressed spring, which release is achieved by a manual unlocking of the spring.

2. A hand-operated binding device according to claim 1, wherein said manual drive means drives said first guide member to pivot with a press means, which is moved by a means that also serves to move a means for pressing said binding band in said manual transport means.

3. A hand-operated binding device according to claim 2, wherein said manual drive means and said manual transport means include:

a transport passage for transporting said binding band;

a slider which is movable forwardly and backwardly;

a press shaft connected at the proximal end thereof to said slider;

a press head connected to the distal end of said press shaft to press the proximal end portion of said first guide member to thereby reduce the space defined by said first and second guide members;

a movable block supported on said press shaft in such a manner as to be slidable between said slider and said press head;

an arm attached at the proximal end thereof to said movable block;

a press plate supported on the distal end of said arm in such a manner as to be pivotable within a predetermined angle range, said press plate being capable of pressing, when moving forwardly, the head portion of said binding band to transport said binding band along said transport passage and of pivoting, when moving backwardly, in such a manner as to bypass the head portion of the following binding band;

a spring which biases said press plate to a position where it presses the head portion of said binding band;

press means having a spring which is interposed between said slider and said movable block to allow said slider, said press shaft and said press head to move forwardly when the transport of said binding band by said press plate is stopped;

a constant-load spring device having a constant-load spring the distal end of which is connected to said slider to move forwardly said press means by the force with which said constant-load spring is rewound onto a reel, thereby pressing said binding band;

a pivotable lock lever capable of locking said press means at a position where said press means is moved backwardly with said constant-load spring being unwound against the resilience thereof, thereby stopping the forward movement of said press means;

a spring for biasing said lock lever in such a manner as to lock said press means;

an operating member;

a movable plate which is driven by manually operating said operating member to pivot said lock lever against the resilience of said spring so as to release said press means; and a spring for retaining said first guide member such that said first guide member closes said space in cooperation with said second guide member.

4. A hand-operated binding device according to claim 3, wherein said first and second guide members are pivotably supported, and said drive means for pivoting said second guide member by a manual operation includes an operating member, a connecting means which is driven by manually operating said operating member to activate said second guide member to open and close said space, which is defined thereby in cooperation with said first guide member, with respect to the outside, and a spring for retaining said second guide member such that said second guide member closes said space in cooperation with said first guide member.

5. A hand-operated binding device according to claim 3, wherein said constant-load spring is enlarged in width at a portion thereof which pulls said slider, said press shaft and said press head to move them forwardly against the resilience of said spring.

6. A hand-operated binding device according to claim 3, further comprising means for stopping the backward movement of said binding band when said press means moves backwardly.

7. A hand-operated binding device according to claim 6, wherein said backward movement stopping means includes teeth capable of engaging said engagement portions of said band portion when said binding band moves backwardly, and a spring which presses said binding band against said teeth.

8. A hand-operated binding device according to claim 1, further comprising means for limiting the reduction of said space for accommodating an object to be bound in order to bind said object loosely.

9. A hand-operated binding device according to claim 8, wherein said limiting means limits the drive of at least one of said first and second guide members to thereby limit the reduction of said space for accommodating an object to be bound.

10. A hand-operated binding device according to claim 8, wherein said limiting means defines the position of an object to be bound with a limit member to thereby limit the reduction of said space for accommodating said object.

11. A hand-operated binding device according to claim 1, further comprising manual stretching means for pulling by a manual operation the distal end portion of said band portion that is passed through said hole in said head portion of said binding band.

12. A hand-operated binding device according to claim 11, wherein said manual stretching means includes a movable plate which is moved by a manual operation, a frame-shaped portion formed on said movable plate, a stretching member with teeth which is pivotably supported on said frame-shaped portion to press said band portion of said binding band against the inner surface of said frame-shaped portion to thereby pull said band portion, a spring for biasing said stretching member toward the inner surface of said frame-shaped portion, and means for releasing said stretching member from said band portion after said band portion has been stretched.

13. A hand-operated binding device according to claim 1, further comprising means for cutting off by a manual operation the distal end portion of said band portion that projects from said head portion of said binding band.

14. A hand-operated binding device according to claim 13, wherein said manual cutting means for cutting off said projecting end portion of said band portion includes a cutter slidably supported, a spring for biasing said cutter to a position where a portion of said band portion of said binding band which is passed through said head portion is allowed to pass, and a connecting means for sliding said cutter against the resilience of said spring by a manual operation to cut off said band portion along said head portion.

15. A hand-operated binding device according to claim 1, further comprising means for cutting off by a manual operation said binding band from another, which are fed in series.

16. A hand-operated binding device according to claim 1, further comprising means for cutting off by a manual operation the distal end portion of said band portion that projects from said head portion of said binding band, and means for cutting off by a manual operation said binding band from another, which are fed in series.

17. A hand-operated binding device according to claim 16, wherein said manual cutting means for cutting off said projecting end portion of said band portion includes a first cutter slidably supported, a spring for biasing said first cutter to a position where a portion of said band portion of said binding band which is passed through said head portion is allowed to pass, and a connecting means for sliding said first cutter against the resilience of said spring by a manual operation to cut off said band portion along said head portion, and said manual cutting means for cutting off said binding band from another includes a second cutter pivotably supported, said second cutter being engaged with said first cutter, and a spring which biases, when said first cutter is in a cutting stand-by position, said second cutter to a position where the passage of said binding band is allowed, and allows, when said first cutter is in a cutting position, said second cutter to pivot to a position for cutting off said binding band.

18. A hand-operated binding device according to claim 1, wherein said manual transport means transports said binding band along a transport passage, which has a connection with a cartridge accommodating a large number of binding bands connected in series longitudinally and wound up in such a manner that said binding bands are capable of being fed longitudinally.

19. A hand-operated binding device according to claim 1, further comprising a grip for holding said device by hand.

* * * * *